United States Patent [19]

Rossignol

[11] Patent Number: 4,662,285

[45] Date of Patent: May 5, 1987

[54] PASSENGER AERIAL CABLEWAY

[75] Inventor: Robert Rossignol, Gieres, France

[73] Assignee: Pomagalski S.A., Fontaine, France

[21] Appl. No.: 242,249

[22] Filed: Mar. 10, 1981

[51] Int. Cl.[4] ..... B61B 11/00

[52] U.S. Cl. ..... 104/173.2; 104/28

[58] Field of Search ..... 104/173 ST, 173 R, 28

[56] References Cited

U.S. PATENT DOCUMENTS

| | | | |
|---|---|---|---|
| 3,112,710 | 12/1963 | Van Evera | 104/173 ST |
| 3,330,223 | 7/1967 | Gaynor | 104/173 ST |
| 3,339,496 | 9/1967 | Sneller | 104/173 ST |
| 3,431,866 | 3/1969 | Bouladon et al. | 104/28 X |
| 3,981,248 | 9/1976 | Savage | 104/173 ST |
| 4,0i03,314 | 1/1977 | Pearson | 104/173 ST |
| 4,050,385 | 9/1977 | Gurr et al. | 104/28 |

FOREIGN PATENT DOCUMENTS

| | | | |
|---|---|---|---|
| 1530686 | 5/1968 | France | 104/173 ST |
| 2236707 | 2/1975 | France | 104/173 ST |

*Primary Examiner*—Robert B. Reeves
*Assistant Examiner*—Glenn B. Foster
*Attorney, Agent, or Firm*—Parkhurst & Oliff

[57] ABSTRACT

Aerial chairlift comprising at the loading station two separate loading areas spaced apart along the travel path of the chairs. Each loading area comprises separate lanes for queuing skiers normally closed by gates. A traffic control system for controlling boarding of the chairlift is actuated by the arrival of chairs at a predetermined location for causing alternate opening of the gates so that the successive chairs are loaded at separate loading areas.

6 Claims, 3 Drawing Figures

PASSENGER AERIAL CABLEWAY

The present invention relates to an aerial cableway particularly a chairlift for transporting passengers from a bottom station to a top station.

It is an object of the present invention to increase the effective uphill lift capacity of the cableway.

Another object is to increase the rate at which the passengers can be loaded at the loading station.

It is well known that the rate at which skiers can be transported by conventional cableways or chairlifts is limited by the loading rate of the passengers and it has been proposed to increase this loading rate by positively moving the skiers towards the loading zone by transport means. Devices of this type are difficult to use in that the transport means must be synchronized with the advancement of the chairs.

Chairlifts having chairs suspended from trucks which may releasably grip the cable for advancement therewith have also been proposed. The chairs may be uncoupled from the cable and slowed down in the loading station for loading at a speed lower than the speed of the cable. Devices of this type suffer the shortcoming that the capability is still restricted by the rate at which skiers may be loaded onto the chairs and the chairs will be spaced apart relatively great distances on the cable.

In another known cableway (U.S. Pat. No. 4,050,385) a pair of first and second shuttle tracks are provided at the loading station and lead from the return run of the cable to separate first and second boarding stations and then lead back to the transport run of the cable. The two different tracks provided in the loading station form a rather circuitous route to enable the skiers to travel to the loading areas. Further, the advancement of the chairs along the two tracks must be synchronized and the truck drive system is complicated.

In accordance with the present invention, two loading areas spaced apart along the travel path of the chairs in the loading station are provided and each chair passes successively along the two loading areas but is loaded only at one of these loading areas. If one chair is loaded at one loading area the following chair is loaded at the other loading area so that the skiers at the loading areas dispose of much time to advance to the loading area. Each loading area is equipped with GO signal means so that the skiers move to the loading area only by the arrival of the corresponding chair. Each loading station may be provided with two or more loading areas and the loading rate of each loading area is thereby accordingly reduced. One of these loading areas may of course be reserved for the equipments or passengers having some priority.

The chairs may be rigidly coupled to the cable and advance in the station at the speed of the cable, the two loading areas being adjacent the travel path of the chairs but it will be apparent that the boarding system according to the present invention may be advantageously used for chairlifts wherein the chairs, uncoupled from the cable, are decelerated and/or are stopped at the loading station, so that the skiers are loading onto stationary chairs. In the station the chairs must be enough spaced apart so that the progression of the skiers towards the loading areas does not interfere with that of the chairs.

The progression of the skiers is controlled by a traffic control system displaying a GO signal to the skiers awaiting a chair on separate lanes as soon as the corresponding chair approaches the loading area. The control system is synchronized with the passage of the chairs at the loading areas so that the skiers may move to the loading area only after the chair has cleared the skier's path.

One of the loading areas may be located in the arcuate portion of the transfer path and the chairs may be double chairs or three passengers chairs, each loading area having two or three lanes. The two or three gates of these lanes may be opened at the same time or successively as soon as the chair has cleared the path. The gates reclose automatically before arrival of the following chair.

The objects and advantages of the present invention will become more clear from the following detailed description of the drawing wherein.

Figures 1, 2:
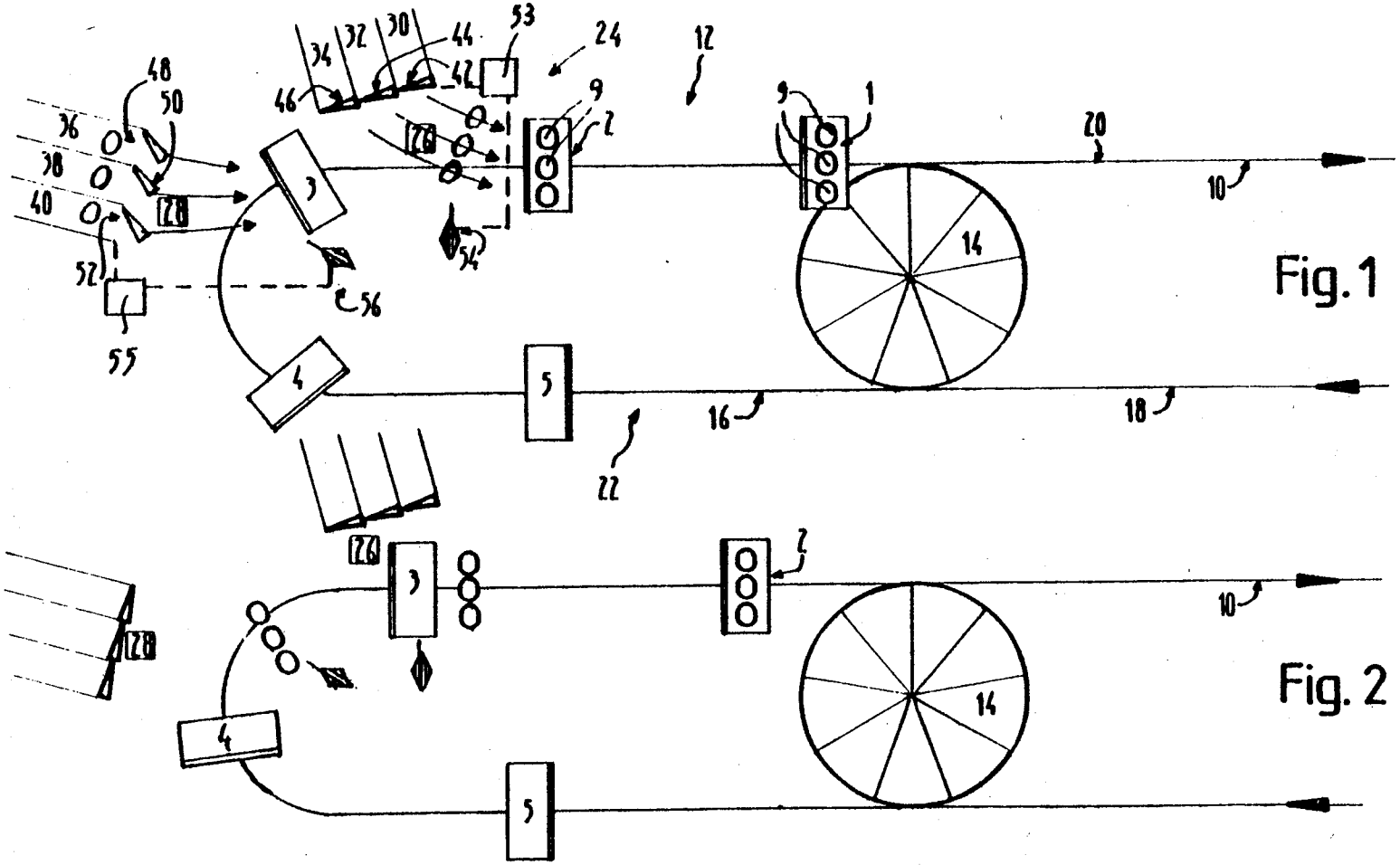
FIGS. 1 and 2 are schematic top plan views of a bottom station included in a passenger chairlift shown at two different instants.
Figure 3:
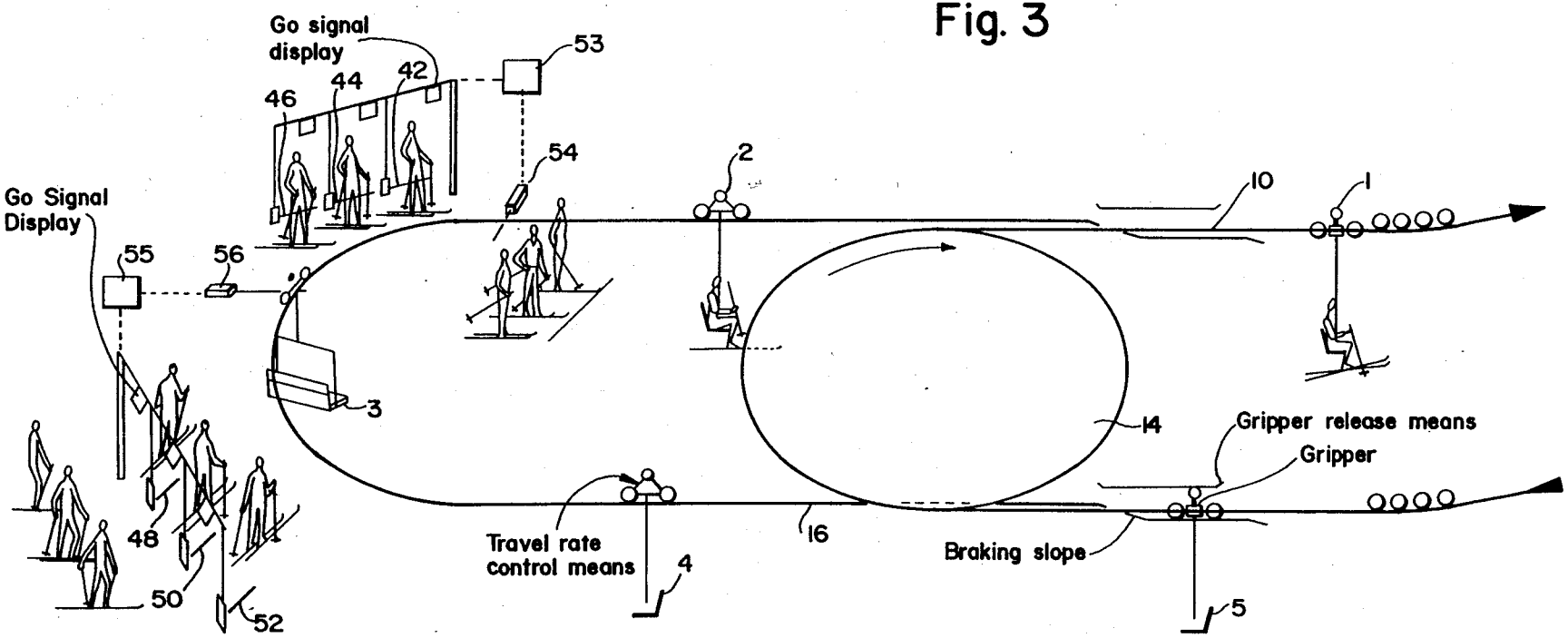
FIG. 3 shows a second schematic plan view of the bottom station.

While the present invention may be used with any type of mechanism generally known as a ski lift for transporting skiers up a mountain, for purpose of illustration, it is shown with a chairlift.

In the chairlift illustrated, a cable 10 is moved in an endless path leading from a bottom station 12 to a top station (not shown) and having a downhill run 18, an uphill run 20, a downhill direction reversing and driving bullwheel 14 and an uphill direction reversing bullwheel (not shown). Chairs 1, 2, 3, 4, 5 . . . are suspended from the cable by means of trucks including a gripper mechanism releasably gripping such cable and wheels riding on a loop rail track 16 provided at the station 12 and leading from the downhill run 18 to the uphill run 20 along an unloading zone 22 and a loading zone 24. The chairs are decelerated upon release from the cable 10 for unloading of skiers at the unloading zone 22 and subsequent loading of skiers at the loading zone 24. This deceleration may be effected by an of various mechanisms well known in the art. For example, deceleration of the cars may be achieved by using escort car such as disclosed in U.S. Pat. No. 4,050,385. The chair trucks are driven along the rail track 16 by haulage chains or cables or by gravity and then accelerated to synchronize the speed thereof with the speed of the cable 10 before gripping thereof. Chairlifts of this type are well known (U.S. Pat. No. 4,050,385).

According to the present invention, the loading zone 24 comprises two successive loading areas 26, 28 spaced apart along the loop rail track 16, the loading area 26 being located in the straight portion of the track while the loading area 28 is located in the arcuate portion of the track 16 before area 26, in such a manner that the chairs 1–5 move first along the arcuate loading area 28 and thereafter along the straight loading area 26. Each loading area 26, 28 comprises three parallel separate lanes 30, 32, 34; 36, 38, 40 for queuing skiers awaiting a chair. The three lanes 30–40 terminate at a location adjacent said loading areas 26, 28 and receive three skiers moving forward abreast towards a chair for three passengers. The chairlift may of course have loading areas 26, 28 with two or more lanes when the chairs may carry two or more passengers. Each lane 30–40 is normally closed by means of an arresting bar or a gate 42, 44, 46; 48, 50, 52 positioned adjacent the termination of the lane and movable into the opened position by actuating means or motors 53, 55. The gates 42–52 are actuated by the arrival of a chair at a predetermined location for opening the lane and controlling boarding of the chairlift. The gate actuating device 53, 55 has a control mechanism such as detectors 54, 56 for detecting the passage of a chair at a predetermined location. This detector 54, 56 may include an automatic sensor such as a photoelectric sensor or a chair engaging electric switch, which will operate for example every time that a chair moves along, but the control mechanism will operate the gates 42–52 only one time out of two. According to FIG. 1 the gates 48, 50, 52 are actuated by the passage of the chairs 1, 3, 5 . . . along detector 56 while the gates 42, 44, 46 are actuated by the passage of the chairs 2, 4, 6 . . . along detector 54. The detectors 54, 56 are placed near the loading areas 26, 28 in such a manner that the gates are opened immediately after the detected chair has moved past the lanes. The opened gates will be closed automatically after a predetermined delay so that the skiers are stopped when a chair approaches the loading area and interferes with the skier's path. It is understood that the closing of the gates may be controlled automatically by other detectors (not shown) which detect the approach of a chair towards the loading area and that the chairs may be individualized, the chairs 1, 3, 5 . . . causing operation of detector 56 and opening of gates 48, 50, 52, and the chairs 2, 4, 6 . . . causing operation of detector 54 and opening of gates 42, 44, 46. Further, the control system may comprise only one detector which may be energized by the passage of each chair and may alternately open the gates 42–46 and the gates 48–52 at a predetermined time delay to synchronize the opening of the gates with the passage of the chairs. In such a case the location of the loading areas must correspond to the selected time delay.

In the position shown in FIG. 1, chair 1 is in the accelerating zone before gripping of cable 10. Three skiers 9 have been loaded onto chair 2 at the loading area 28 and chair 2 travels along rail track 16 towards the accelerating zone. At the passage of detector 54 chair 2 has opened temporarily the gates 42, 44, 46, which are already reclosed and three skiers advance to the loading area 26 as shown by the arrows. Chair 3 has moved past loading area 28 and approaches loading area 26 to load the three skiers. Chair 3 has actuated detector 56 and the gates 48, 50, 52 are opened to permit to the skiers awaiting on lanes 36, 38, 40 to advance to the loading area 28 to be loaded on chair 4. The open gates 48, 50, 52 will be closed before the arrival of chair 4 to avoid collision between the chair 4 and the skiers advancing to the loading area 28. Chair 5 is in the unloaded zone. It is noted that the chairs 1, 3, 5 . . . are loaded at the loading area 26 and the chairs 2, 4, 6 . . . at the loading area 28. FIG. 2 shows the chairlift a few moments later. Chair 1 is already on the line and chair 2 will be coupled to cable 10. Chair 3 is at the loading area 26 for loading the three skiers. Chair 3 actuates detector 54, but the control means inhibits this signal and the gates 42–46 remain closed. Chair 4 approaches the loading area 28 and the gates 48–52 are already reclosed.

It will be appreciafted that the opening cycle of the gates 42–52 is only the half of that of the chairs passing at the loading zone 12 and that the skiers have more time for preparation. Further the number of loading areas may be increased as desired.

It is clear that the lanes 42–52 are spaced apart along the chair travel path and that each lane can be opened as soon as the chair has moved past this lane. Instead of having all the three gates 42–46; 48–52 opened together when the chair has moved past the loading area 26, 28, the gates are advantageously opened successively as soon as the chair has cleared the passage. In the shown embodiment, the three gates are on the same line perpendicular to the lanes direction but the gates 42, 44; 48, 50 may be located nearer of the track 16 without blocking the way of the chairs.

The gates 42–46; 48–52 are advantageously mounted on a removable structure which may be put on the snow. Advancement of the chairs may be briefly stopped at the loading areas 26, 28, particularly at the arcuate loading area 28 for the loading of skiers thereon.

The spacing and the travel speed of the chairs 1–5 in the loading zone 12 are of course adapted to the rate at which the skiers may advance to the loading area 26, 28 and may be loaded onto the chairs.

It will be noted that the arrangement of two loading areas spaced apart along the travel path of the chairs in the loading station may be used with different ski lift devices such as gondola lifts or chairlifts. The chairs may be permanently coupled to the cable and move along the loading zone in the station with the same speed as the cable.

The chairs face advantageously in the direction of travel of the cable but they may be pivoted and face sideways for loading and/or for advancement up the ski run.

Safety sensors may determine the presence of a passenger and prevent opening of the gates if the approaching chair is already loaded.

What is claimed is:

1. A method of loading passenger carrying vehicles of an aerial cableway comprising:

transporting a plurality of passenger carrying vehicles, including the chair or gondola portions thereof, along a single travel path from a loading station to an unloading station along transport and return runs, providing at least first and second loading areas at the loading station, spaced apart longitudinally along the single travel path of said vehicles, passing each vehicle by each of said at least first and second loading areas successively, marking each loading area for queuing skiers awaiting a vehicle into a plurality of separate lanes, the number of lanes corresponding to the number of passengers transported by each vehicle, each lane terminating at a location adjacent said travel path without interference with the vehicle, displaying a GO signal for each said lane, controlling the display of the GO signals for the lanes of each of the loading areas, so that before each vehicle travels past the loading areas the GO signals for only one loading area are activated, the display of the GO signals for the lanes of each loading areas being activated by the arrival of a vehicle at a predeftermined location only one time out of the number of loading areas, whereby successive vehicles are loaded at successive loading areas, such as one at the first loading areas and the next at the second loading area in the case of two loading areas.

2. The method of claim 1, further comprising:

releasing said vehicles from a cable as said vehicles move into said travel path at the loading station, and slowing the rate of travel of the vehicles at the loading station.

3. The method of claim 2, further comprising:

producing a signal indicating that a vehicle has cleared the passaged of the lanes of one of said at least first and second loading areas, and displaying the GO signal for the lanes of said one loading area upon detection of said signal.

4. The method of claim 1, further comprising:

producing a signal indicating that a vehicle has cleared the passage of the lanes of one of said at least first and second loading areas, and displaying the GO signal for the lanes of said one loading area upon detection of said signal.

5. The method of claim 1, further comprising:

locating one of said loading areas in an arcuate section of said travel path.

6. The method of claim 1, further comprising:

equipping each of the lanes of each said loading area with a pivotally normally closed arresting bar, opening the arresting bars for one of the loading areas at the arrival of a vehicle at a predetermined location only one time out of the number of loading areas, and reclosing the arresting bars of said one loading area after a predetermined delay before the arrival of the following vehicle.

* * * * *